US011612547B2

(12) United States Patent
Castillo

(10) Patent No.: US 11,612,547 B2
(45) Date of Patent: Mar. 28, 2023

(54) PACIFIER RETENTION DEVICE

(71) Applicant: LB Accessories LLC, Sacramento, CA (US)

(72) Inventor: Megan Castillo, Sacramento, CA (US)

( * ) Notice: Subject to any disclaimer, the term of this patent is extended or adjusted under 35 U.S.C. 154(b) by 13 days.

(21) Appl. No.: 17/044,326

(22) PCT Filed: Apr. 11, 2019

(86) PCT No.: PCT/US2019/027098
§ 371 (c)(1),
(2) Date: Oct. 1, 2020

(87) PCT Pub. No.: WO2019/200176
PCT Pub. Date: Oct. 17, 2019

(65) Prior Publication Data

US 2021/0077358 A1 Mar. 18, 2021

Related U.S. Application Data

(60) Provisional application No. 62/655,849, filed on Apr. 11, 2018.

(51) Int. Cl.
*A61J 17/00* (2006.01)

(52) U.S. Cl.
CPC ..... *A61J 17/1115* (2020.05); *A61J 17/00* (2013.01)

(58) Field of Classification Search
CPC ..... Y10T 24/1397; A61J 17/00–113; A01K 27/004; A45F 5/00–14
USPC ..... 242/378–378.4
See application file for complete search history.

(56) References Cited

U.S. PATENT DOCUMENTS 1,276,825 A * 8/1918 Swope ..... B65H 75/4449 242/378.2
2,262,587 A * 11/1941 Kaempf ..... B65H 75/36 242/376
2,596,648 A * 5/1952 Bugg ..... B65H 75/486 242/375.1
3,372,887 A * 3/1968 Ladany ..... H02G 11/02 242/378.1
3,657,491 A * 4/1972 Ryder ..... H02G 11/02 191/12.2 R
4,646,987 A * 3/1987 Peterson ..... H04M 1/15 191/12.2 R
4,977,860 A * 12/1990 Harwell ..... A01K 27/004 119/794
5,535,960 A * 7/1996 Skowronski ..... H04M 1/15 242/378.4
5,595,143 A * 1/1997 Alberti ..... A01K 27/004 119/794
5,684,883 A * 11/1997 Chen ..... H02G 11/02 381/370

(Continued)

*Primary Examiner* — Tan-Uyen T Ho
*Assistant Examiner* — Charles M Wei
(74) *Attorney, Agent, or Firm* — Au LLC; Adam E. Urbanczyk

(57) ABSTRACT

A pacifier retention device comprising a tether having a proximal end and a distal end, a housing, a spool with channeled surface, spiral spring, and fasteners attached to the ends of the tether. The proximal and distal ends of the tether are connected to a clothing clip and a loop, respectively. The clip is attached to a piece of clothing while the loop is intertwined with a pacifier, the tether being under constant or configurable tension to prevent unwanted travel of the pacifier when not in use.

8 Claims, 12 Drawing Sheets

(56) References Cited

U.S. PATENT DOCUMENTS 5,957,399 A * 9/1999 Siana, Jr. ..... B65H 75/40 242/377
6,241,750 B1 * 6/2001 Moultrie ..... A45F 5/004 606/234
6,434,797 B1 * 8/2002 Sagman ..... A61J 17/111 24/3.13
6,616,080 B1 * 9/2003 Edwards ..... A45C 7/0045 191/12.2 R
6,834,820 B2 * 12/2004 Wei ..... B65H 75/4449 191/12.2 R
6,871,812 B1 * 3/2005 Chang ..... B65H 75/4434 191/12.4
7,172,150 B1 * 2/2007 Hutchison, II ..... B65H 75/4449 191/12.2 R
7,216,665 B1 * 5/2007 Sims, Jr. ..... A61M 39/08 137/355.19
7,784,727 B1 * 8/2010 Liao ..... B65H 75/4434 242/378.1
8,077,149 B2 * 12/2011 Yang ..... G06F 3/03543 345/163
8,774,443 B1 * 7/2014 Anderson ..... H04R 1/1033 381/375
9,339,678 B2 * 5/2016 Gallagher ..... A61B 5/024
9,908,742 B2 * 3/2018 Mertesdorf ..... B65H 57/20
11,071,284 B2 * 7/2021 Colvin ..... B65H 75/4492
2005/0247813 A1 * 11/2005 Kovacevich ..... F16G 11/12 242/388.6
2010/0062915 A1 * 3/2010 LaSala ..... A61H 15/0092 482/127
2010/0181352 A1 * 7/2010 Imafuku ..... A45F 5/004 224/162
2013/0008392 A1 * 1/2013 Holmstrom ..... B25G 1/06 119/796
2016/0338323 A1 * 11/2016 Nishida ..... A01K 27/004
2018/0028412 A1 * 2/2018 Todd ..... A61J 1/00
2020/0397127 A1 * 12/2020 Jeong ..... A45F 5/004
2021/0090472 A1 * 3/2021 Wyatt ..... B65H 75/446

* cited by examiner

PACIFIER RETENTION DEVICE

CROSS-REFERENCE TO RELATED APPLICATIONS

The present application claims the priority of U.S. provisional application No. 62/655,849 filed on Apr. 11, 2019.

FIELD OF THE INVENTION

The present invention relates to a retractable pacifier device for infants and toddlers. More particularly the subject matter of this disclosure relates to clipping one or more ends of a retracting device to a piece(s) of material while connecting the other end of the device to a pacifier.

BACKGROUND OF THE INVENTION

A pacifier is a usually nipple-shaped device for babies to suck or bite on. A pacifier retaining devices is typically a cord, strap or string-like device that provides a means for securing a pacifier within an infant's reach. Pacifier retracting or retaining devices are often attached to the child's clothing or apparel via a clamp, clip or snap lock for detachable attachment to the clothing of an infant. Because pacifier retaining devices usually attach a pacifier to the child's clothing, the child is provided easy access to the pacifier and can choose to use it whenever he pleases. Also, pacifier retaining devices prevent or minimize a pacifier from dropping to the floor less often, keeping the pacifier more sanitary. Further, the pacifier is lost less often, reducing irritation by the child or the guardian.

The retracting device improves and increases the convenience of the user and the buyer of the device. Most retracting devices require that a release button is pushed in order to determine how far the cord body should suspend or retract which is not convenient if a person has to keep coming back and forth to adjust the length of the cord. This makes the use of the device ineffective. This leaves room for the pacifier to touch dirty material and possibly have the extendable length of the cord cause harm to the baby. In order to avoid this situation, it helps to have a retracting cord that acknowledges that the pacifier has been released from the mouth and automatically begins to retract the length of the cord to the smallest length.

The following examples in the prior art illustrate common limitations and weakness. Patent No. JP 2013-183963 A 2013.9.19 discusses a retractable device for a pacifier. This reference describes a sliding lock lever along the side face of the case so as to prevent the string body from unwinding even when the holding function of the holding means for holding the body in the withdrawn state is mistakenly released. The lock lever and hold means are used in conjunction to prevent the movement of the body once the lock lever has been physically adjusted but does not automatically retract the length of the string once the pacifier is released from the mouth. It is not designed with the safety and convenience of the user. The user's caregiver would have to keep coming over to the user to release the lever in order for it to retract. Further, that there is a back-up holding device suggests that the original holding device is not sturdy or strong enough to keep the cord from moving.

U.S. Pat. No. 6,434,797 discusses a retractable device for a pacifier. This reference discloses a brake means for normally holding said cord in a fixed position relative to said housing and resisting winding and retracting of said cord into said housing, said brake means being operable to selectively release said cord in order to permit winding and retracting into said housing so that said distal end zone moves towards said opening. The reference does not disclose that once the pacifier has been released that the cord will automatically retract but will selectively release the cord.

A need exists to overcome the problems with the prior art as discussed above, and the existing retractable devices do not provide durability, reliability, or safety to ensure maximal performance out of the device.

SUMMARY OF THE INVENTION

The present invention is a pacifier retention device comprising a tether, a housing, spool, and fasteners attached to the tether. The ends of the tether are connected to a clip and a loop. The clip is attached to a piece of clothing while the loop is intertwined with a pacifier to improve the efficiency, safety, sanitation, reliability, and durability.

Exemplary embodiments of the present invention include a housing having a front face and a back face, wherein the front and back faces are interposed to form a side wall with an interior cavity. Further, each sidewall comprises at least one opening. A spool is positioned within the interior cavity of the housing is rotatable by means of a shaft secured between the front and back faces of the housing. The rotatable spool comprises multiple slots allowing the passage through the spool, wherein the circumferential surface of the spool comprises of a first and second channel which are parallel to each other. A tether available of different lengths has a proximal and distal end with a midpoint located along the length of the tether. The midpoint of the tether is located substantially within the center of the spool, where the tether's proximal end extends through a first slot of the spool and the distal end extends through a second slot of the spool. A spiral spring or a coil is fixed in the housing, so wherein the tether can be moved under tension between the first and second position, wherein the proximal end is wound around the spool within the first channel and the distal end is wound around the spool within the second channel. When in a first position, the entire length of the proximal end extends from the first slot out of the first channel and out through the first opening and the entire length of the distal end extends from the second slot out of the second channel and out through the second opening.

A principle object of the present invention is to provide an innovative pacifier retention device designed to prevent the pacifier from coming in contact with the ground or floor when it falls or is dropped or spit by the child or infant. Yet another object of the present invention is to improve the safety of the infant by reducing the risk of the tether being wound around the neck of the infant. The above-described and other features and advantages realized through the techniques of the present disclosure will be better appreciated and understood with reference to the following detailed description, drawings, and appended claims. Additional features and advantages are realized through the techniques of the present invention. Other embodiments and aspects of the invention are described in detail herein and are considered a part of the claimed invention.

BRIEF DESCRIPTION OF THE DRAWINGS

The accompanying figures and drawings, incorporated into and forming part of the specification, serve to further illustrate the present invention, its various principles and advantages, and its varying embodiments.

DETAILED DESCRIPTION

In the following description, numerous specific details are set forth to provide a thorough understanding of various embodiments. One skilled in the relevant art will recognize that the techniques described herein can be practiced without one or more of the specific details, or with other methods, components, materials, etc. Well-known structures, materials, or operations are not shown or described in detail to avoid obscuring certain aspects.

This invention relates generally to mechanics, and more specifically to a device and method for providing a retention pacifier device. Details of certain embodiments of the invention are set forth in the following description and in FIGS. 1-11. The present invention may have additional embodiments, may be practiced without one or more of the details described for any particular described embodiment, or may have any detail described for one particular embodiment practiced with any other detail described for another embodiment.

Figure 1:
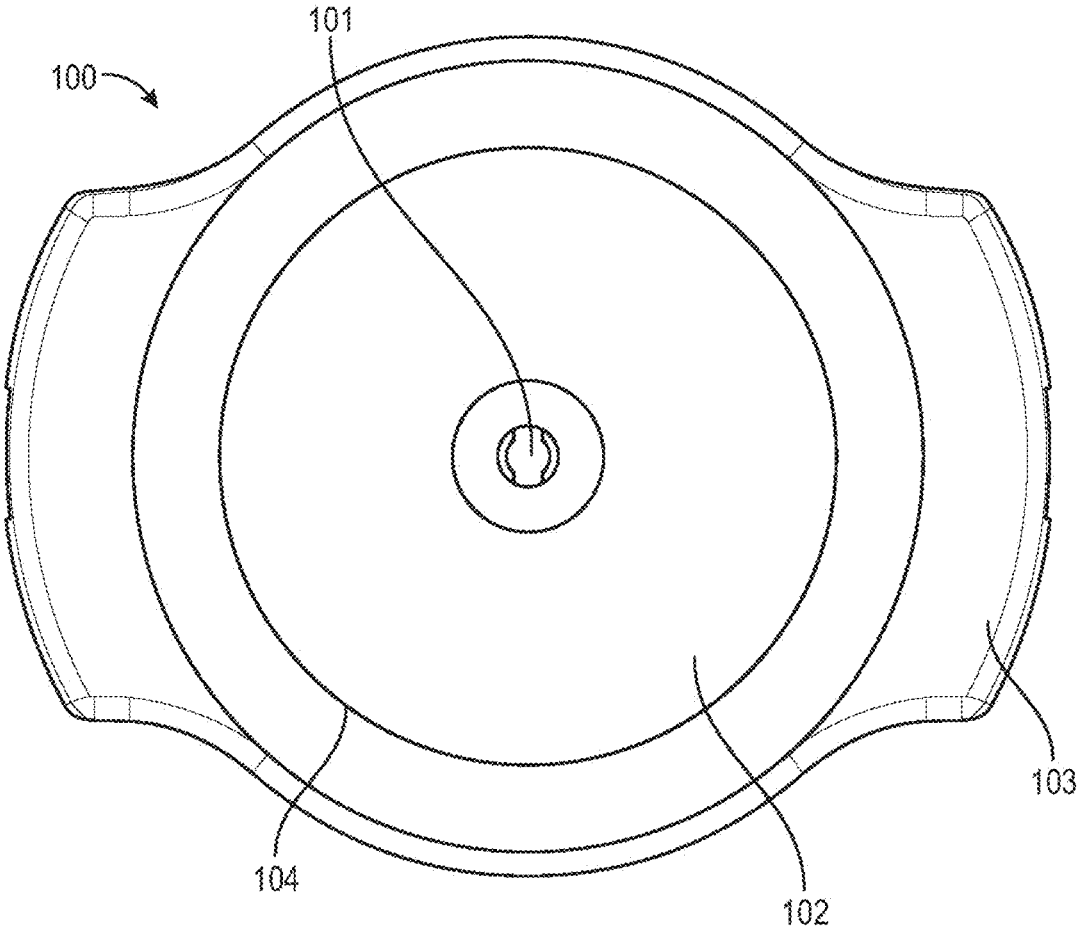
FIG. 1 illustrates a top view of a housing of pacifier retention device.

FIG. 1. illustrates a top view of a housing 100 of a pacifier retention device. A closed circular opening 101 exist on the top 102 of the housing 100. The top 102 of the housing 100 can be of a circular shape that that extends outward on the two sides 103 available. Circular grooves 104 are implemented on the top 102 design. In another embodiment, the housing 100 is constructed of durable plastic, wood, or metal or any material based on requirement, top 102 mounted on the housing 102 can be of any shape such as a square, rectangle, triangle, etc. and can be multi-dimensional apart from the design mentioned in the figure.

Figure 2:
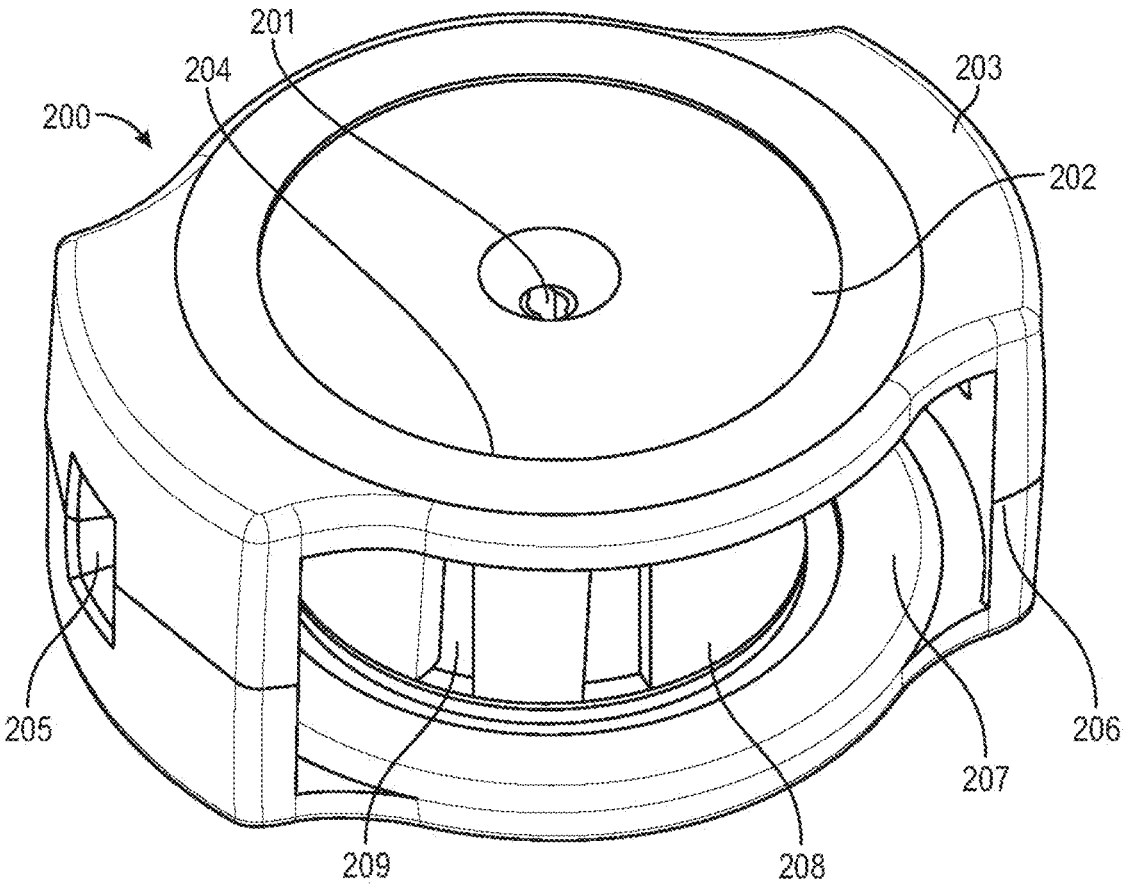
FIG. 2 illustrates a perspective view of the housing of pacifier retention device.

FIG. 2 is a perspective view of the housing 200 includes a front face and back face that are interposed or attached to each other to form at least two sidewalls 206 on opposite sides with an interior portion of the housing 200 with first and second openings 205 are formed respectively on the sidewalls 206 of the housing 200. A spool 208 positioned inside the interior portion of the housing 200 is secured by means of shaft (not shown) located between the front face, back face through a central receiving hole 201, the circumference of the spool 208 comprising slots 209 positioned on the opposite sides as a means to allow passage through the spool 208. The circumference of the spool 208 displays one side of the slots 209 of the same height but of different widths. The spool 208 may include a first channel and second channel disposed in parallel around the spool's circumference.

The spool 208 can extend from the top 202 of the housing 200 to its bottom with a small gap allowing to spool to rotate. Circular grooves 204 are implemented in the interior of the housing 200. The top 202 of the housing 200, which extends outward 203 on both sides.

In alternative embodiment of the invention, the housing 200 can have more than two sidewalls. Alternatively, it is not needed to keep the sidewalls left open. In another embodiment, the length of the spool 208 can be varied based on several parameters such as the diameter of the tether and thereof. In another embodiment of the invention, the front face and back face of the housing 100 can be interposed between each other by any means such as fastening means such as clipping, clamping, adhesive, snapping and thereof. In another embodiment of the invention, the housing 200 can include a spiral spring or a coil (not shown) that be positioned within the spool 208 and the shaft. A first end of the spiral spring inner end is connected to the driving means such as shaft that can be received in the central hole 201, and the second end of the spiral spring is connected to the spool 208. The proximal end of the tether passes through the slots 209 and is wound around the spool 208 within the first channel. When the tether is in a first position, the entire length of the proximal end extends from a first slot in the spool and through the second opening. The spiral spring is provided with a tension force when the pacifier is in the first position and automatically releases the tension when the pacifier is removed or dropped from the infant by unwinding the tether to the smallest length possible. In another embodiment of the invention, the spool 208 can be formed of different shapes such as cylindrical, elliptical, dumbbell, arch, square and rectangular based on the requirement of the user. In another embodiment of the invention, the spiral spring can be mounted in between the spool 204 and housing 200 wherein the first end of the spiral spring is connected to an inner face of the housing 200 and a second end of the spiral spring is connected to the spool 208. In another embodiment of the invention, the tether 204 can be of different lengths and widths depending on pacifier requirements. In another embodiment of the invention, the housing 200 may be located substantially toward end of either the proximal or distal end, depending on usage. In another embodiment of the invention, the shaft can be mounted from the sides or a separate groove(s) can be used to prevent the displacement of the spool and allow to rotate within its position. In another embodiment of the invention, the number of slots 209 formed on the outer circumference of the spool 208 can vary depending whether the tether requires more or less securing as a result of the material with which the tether is made. In another embodiment of the invention, the width and the height of the slot 209 formed on the outer circumference of the spool 208 can be varied based on the nature of the tether. In another embodiment of the invention, the slots 209 formed on the spool 208 can be formed of different shapes such as circular, arch, elliptical, cubical and thereof.

Figure 3:
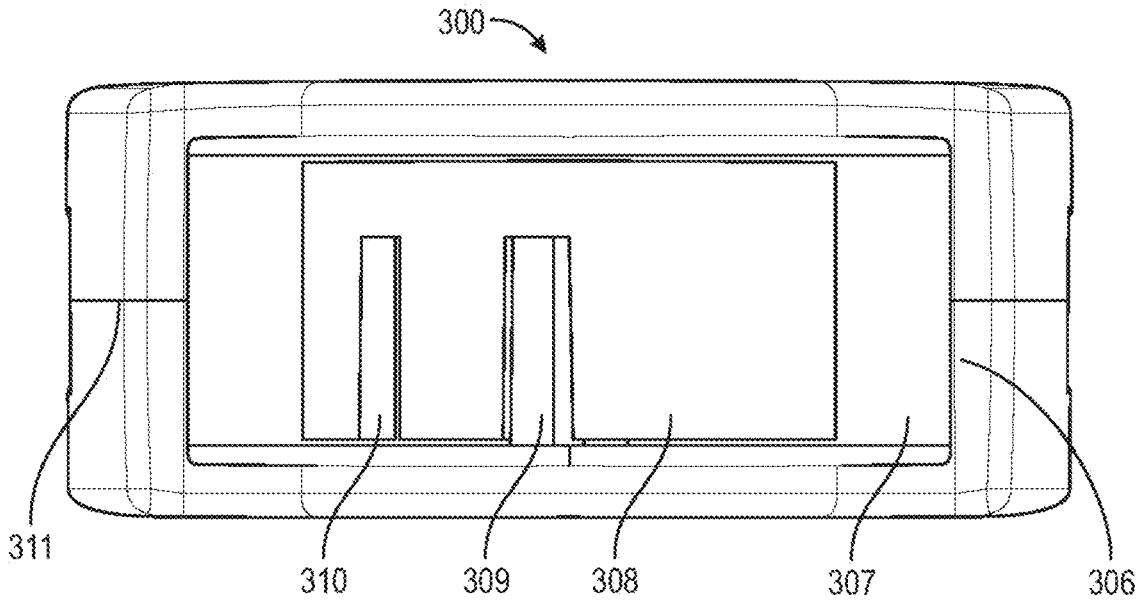
FIG. 3 illustrates a side view of the housing of pacifier retention device.

FIG. 3 is a side view of a pacifier retention device that illustrates a housing 300 comprising a front face and back face interposed to each other to form sidewalls with vertical grooves 306 and 311 each forming a rectangular opening to access the interior portion. The interior portion of the housing 300 includes a spool 308 having two vertical slots 309, 310 adjacent to each other with same height positioned on its outer circumference wherein one slot 309 is wider than the other 310. Further, there is a spacing 307 provided on both sides of the spool 308 positioned in the interior portion of the housing 300. The geometry of the spacing 307 depends on the size of the spool, the housing interior portion, and wounding thickness of the tether.

Figure 4:
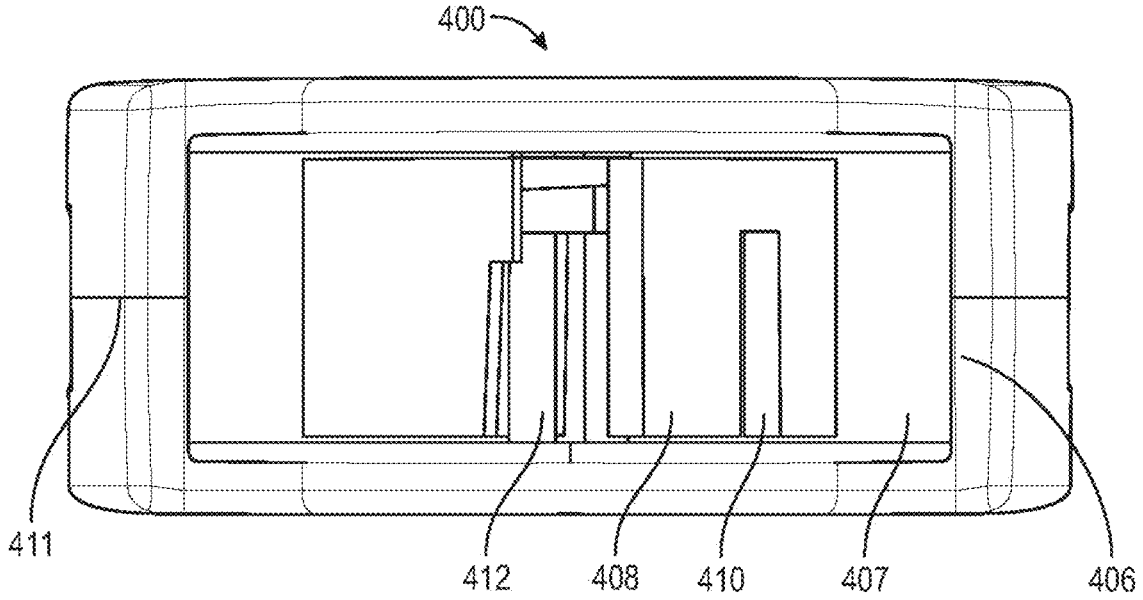
FIG. 4 illustrates the rear view of the housing of the pacifier retention device.

FIG. 4 is a rear view of a housing 400 of a pacifier retention device formed of the front face and back face interposed to each other to form sidewalls with vertical grooves 406 and 411 to form an of the interior portion having a rectangular opening to access it. The interior portion of the housing 400 includes a spool 408 having two vertical slots 410, 412 adjacent to each other of different heights positioned on its outer circumference. Wherein one slot 412 is wider than the other slot 410. A spacing 407 is provided on both sides of the spool 308 positioned within in the interior portion of the housing 400. The geometry of the spacing 407 depends on the size of the spool, the housing interior portion, and thickness of the tether.

Figure 5:
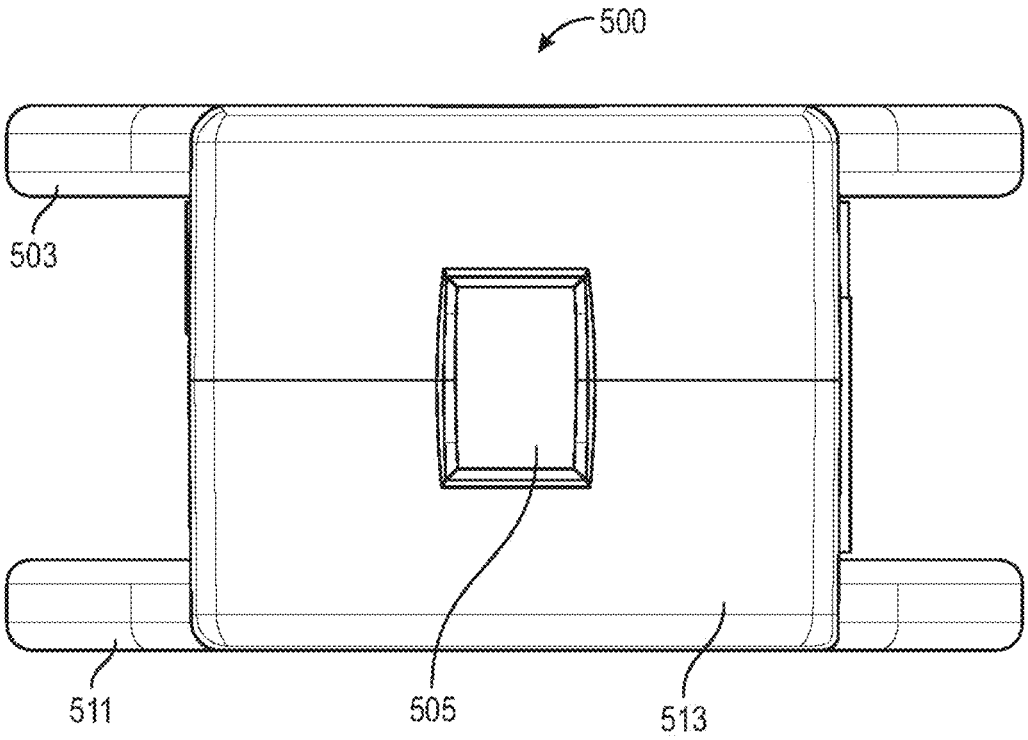
FIG. 5 illustrates the end view of the housing of pacifier retention device.

FIG. 5 illustrates a side view of the housing 500 having sidewalls opposite to each other formed in square shape 513 with a first opening 505. In an alternate embodiment, the sidewalls 513 can be formed of different shapes such as a circle, a rectangle, or a triangle.

Figure 6:
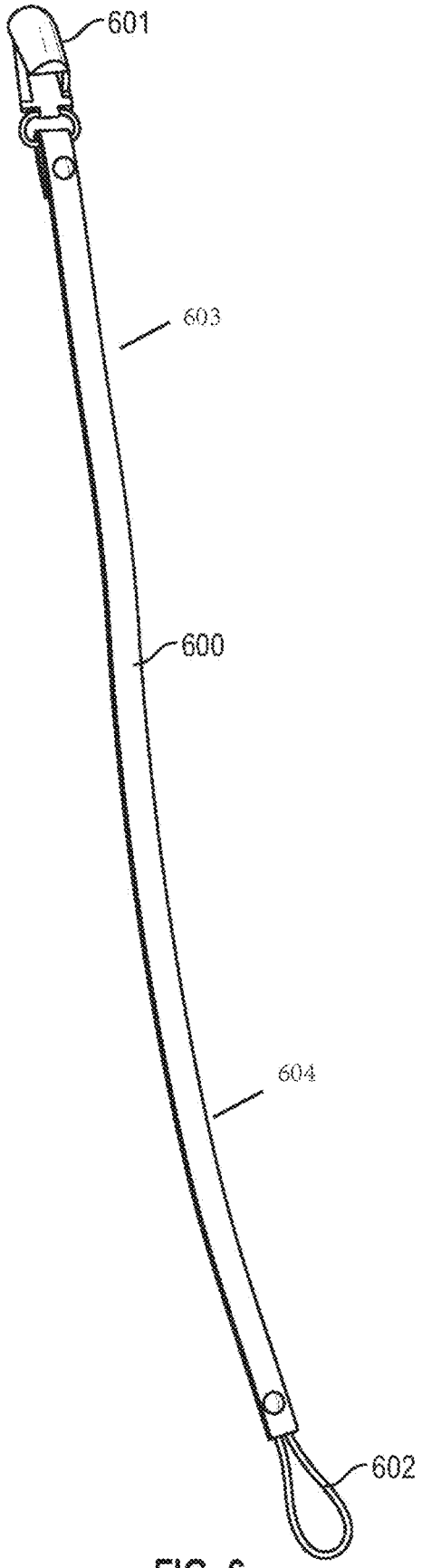
FIG. 6 illustrates the perspective view of a tether that goes into the housing of pacifier retention device.

FIG. 6 illustrates a perspective view of a tether that is to be utilized in a pacifier retention device. A middle portion 600 exists along the tether that has a proximal end 603 and a distal end 604. A clip for fastening onto clothing 601 is disposed onto the proximal end 603. A loop 602 for securing a pacifier is disposed onto the distal end 604. The tether can be made of any color and flexible material such as fabric, rubber, fiber, or plastic. The tether can be made with varying lengths, thicknesses, and widths, constant or tapering, depending on the characteristics of its intended use.

Figure 7:
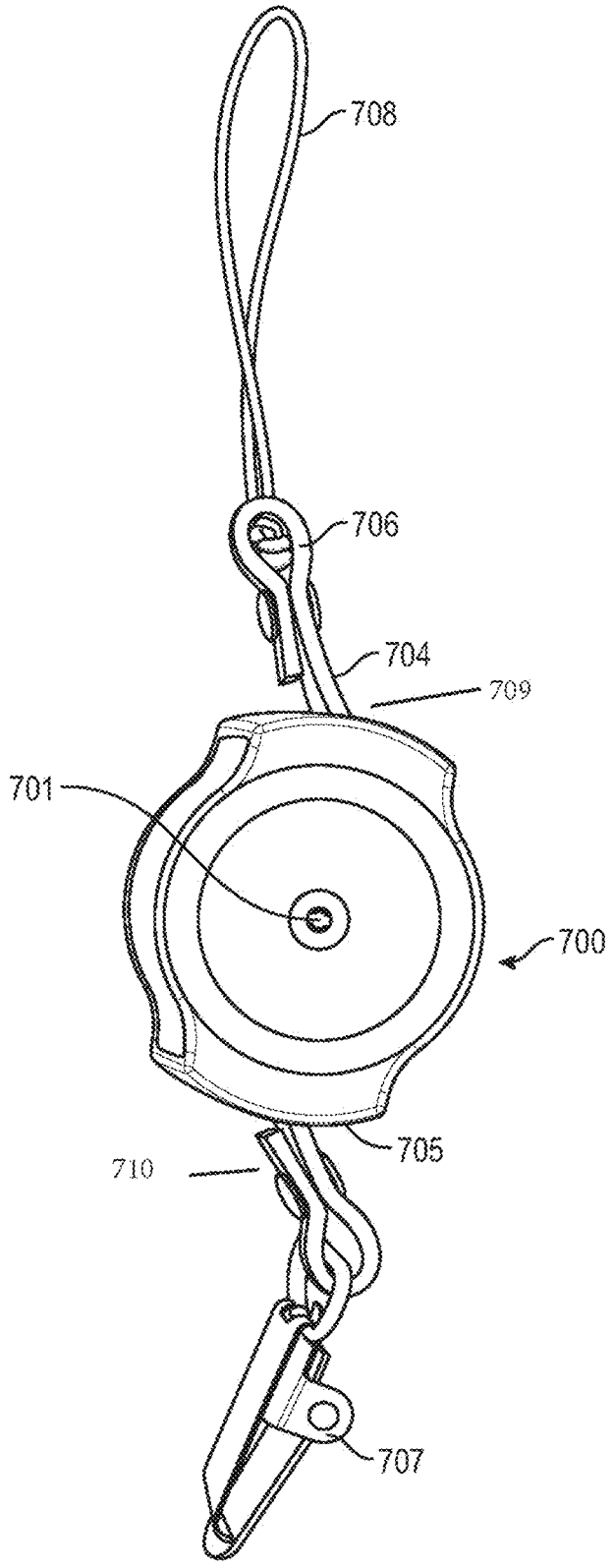
FIG. 7 illustrates the top view of an assembled retractable pacifier device.

FIG. 7 illustrates a top view of an assembled pacifier retention device with a tether in a second position. Illustrated is a housing 700 with a circular opening on the top 701, a distal end 704 of a tether extending through a second opening 709 in the housing. A distal end 710 of the tether extends through the housing through a first opening 705 in the housing. A fastener 707 is disposed onto the proximal end 710 and a loop 708 is disposed onto the distal end 704 being secured by a knot 706. The fastener 707 may be any means for removeably attaching the device to a cloth garment and otherwise be made of any sufficiently durable material such as metal or plastic.

Figure 8:
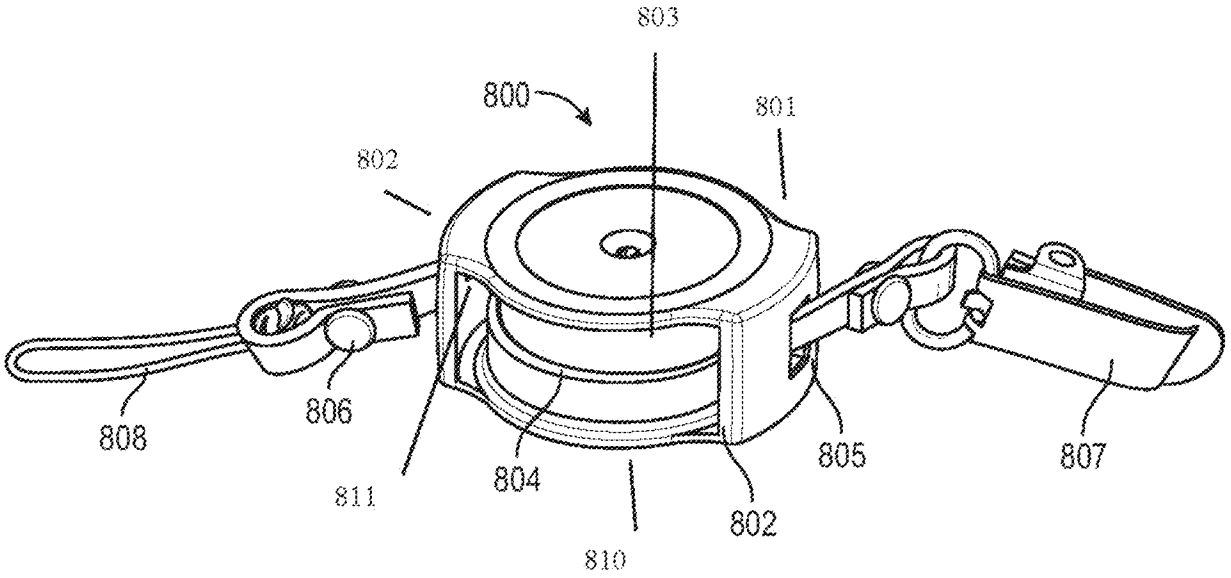
FIG. 8 illustrates the perspective view of retractable pacifier device.

FIG. 8. illustrates a perspective view of an assembled pacifier retention device in a second position. A housing 800 has a front face 801 and a back face 803 which form side walls 802. The proximal end of the tether 804 is wound around the first channel of the spool and passes through the first opening 805 formed on sidewalls 802 of the housing 800, the proximal end of the tether 804 being provided with a fastener clip 807 for attachment to clothing. The distal end of the tether 803 is wound around a second channel of the spool and passes through the second opening 811 formed on a sidewall 802 of the housing 800, the distal end of the tether 803 is provided with a loop 808. The loop 808 is attached to the distal end 803 via a fastener 806. The loop 808 may be made of fiber, plastic, or flexible material.

Figure 9:
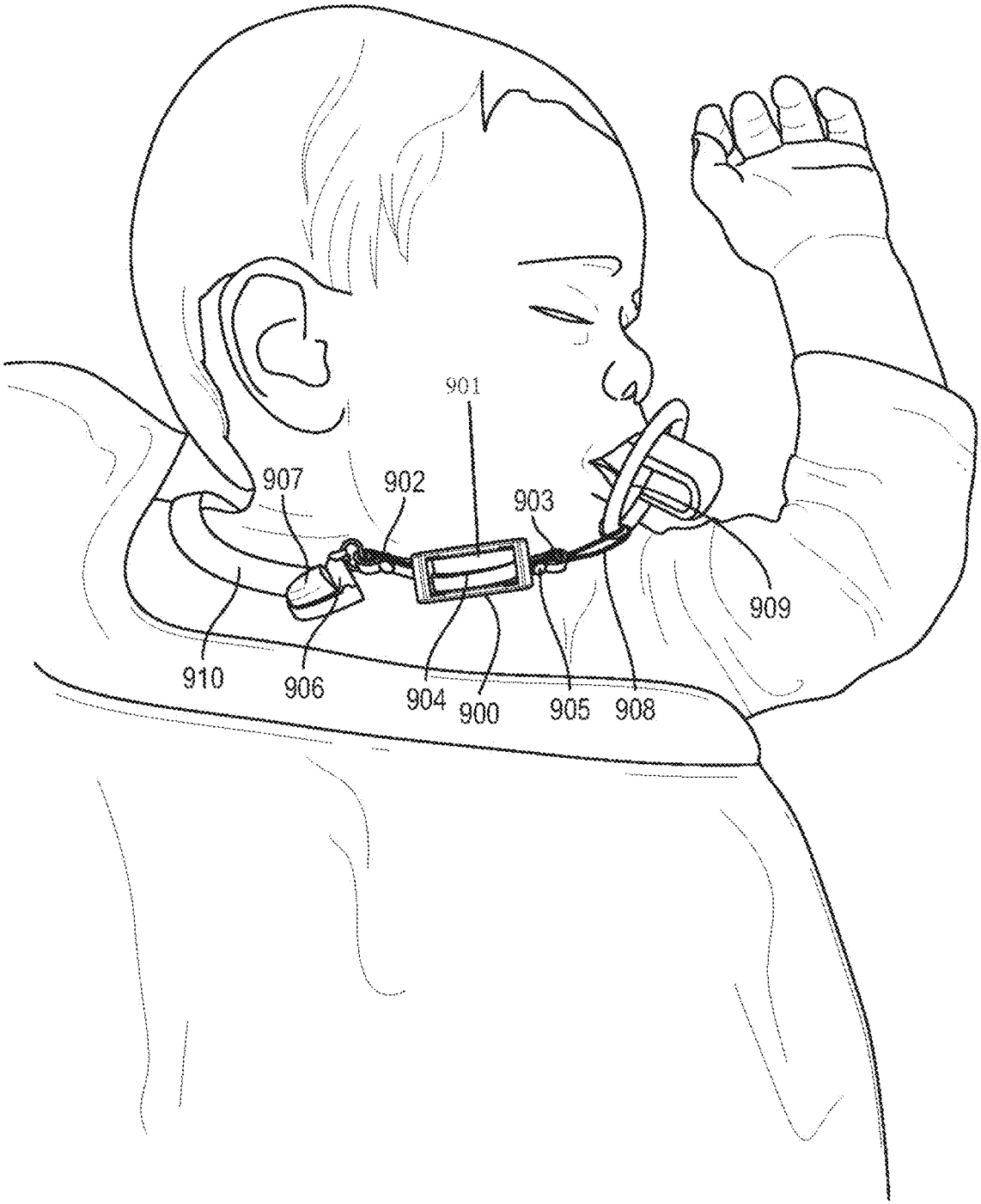
FIG. 9 illustrates the shortness of the tether while the pacifier is in use.

FIG. 9 illustrates an exemplary pacifier retention device in-use. A housing 900 contains a tether in a second position with the proximal end 901 and distal end 904 being wound around the spool in the first channel and parallel second channel, respectively. The distal end 904 terminates in a loop 908 secured to the distal end 904 via a first fastener 905. The loop 908 is secured to a pacifier 909. The proximal end 901 terminates in a clip 906 secured to the proximal end via a second fastener 902. The clip 906 attaches to a garment 910 at a collar portion 907. In another embodiment, a plurality of depressions may be disposed onto a surface of the spool such that a lock member may be selectively engaged to enter into at least one of the depressions through the housing to seize the spool to prevent rotation and movement of the tether. In another embodiment, a threaded member extends from the shaft out through a face of the housing, wherein a nut secures onto the threaded member. The user may tighten the nut onto the threaded member which forces the housing face against the spool to linearly frictionally seize it and prevent its rotation. In an alternate embodiment, a threaded hole is disposed into the shaft through its axis, and a thumbscrew is used to tighten the housing face against the spool.

Figure 10:
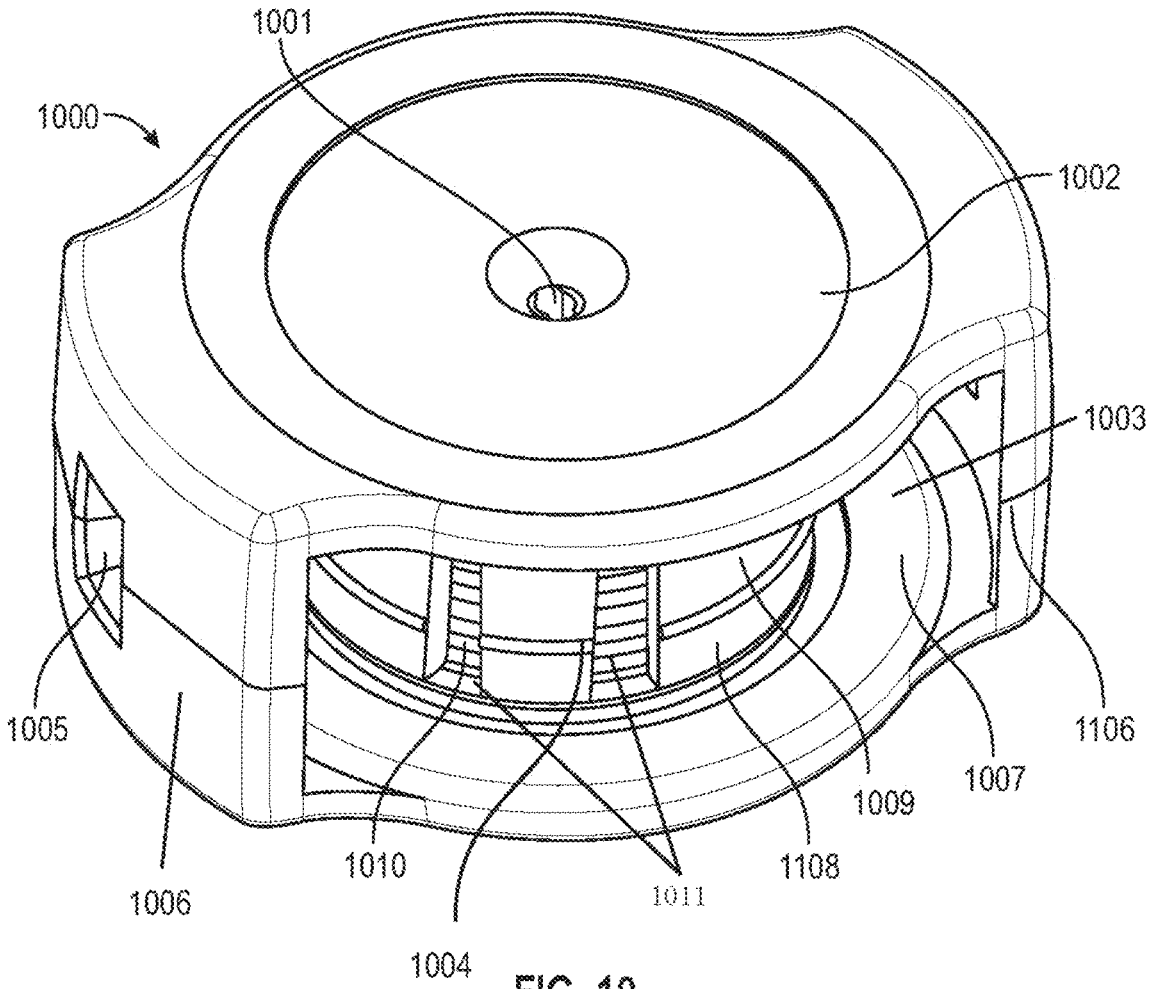
FIG. 10 illustrates a perspective view of the housing with a spiral spring of retractable pacifier device.

FIG. 10 illustrates a perspective view of an exemplary housing 1000. A front face 1002 and a back face 1007 are engaged forming sidewalls 1006 and an interior portion 1003. A spool 1004 is secured within the interior portion 1003 and around a shaft 1001 extending between the front face 1002 and the back face 1007. Onto the surface of the spool are disposed a first channel 1008 and a second channel 1009. A first opening 1005 exists within one sidewall 1006. A spiral spring 1010 is housed within the spool, affixed between an inner surface of the spool and the shaft, to provide angular tension on the spool. Two slots 1011 are disposed onto the spool 1004 and through which a tether may be threaded. In an alternate embodiment, the spiral spring is affixed between a side of the spool and a proximate housing face to provide angular tension on the spool. The geometry and number of slots disposed onto the spool can vary depending on the required tether passage arrangement.

Figure 11:
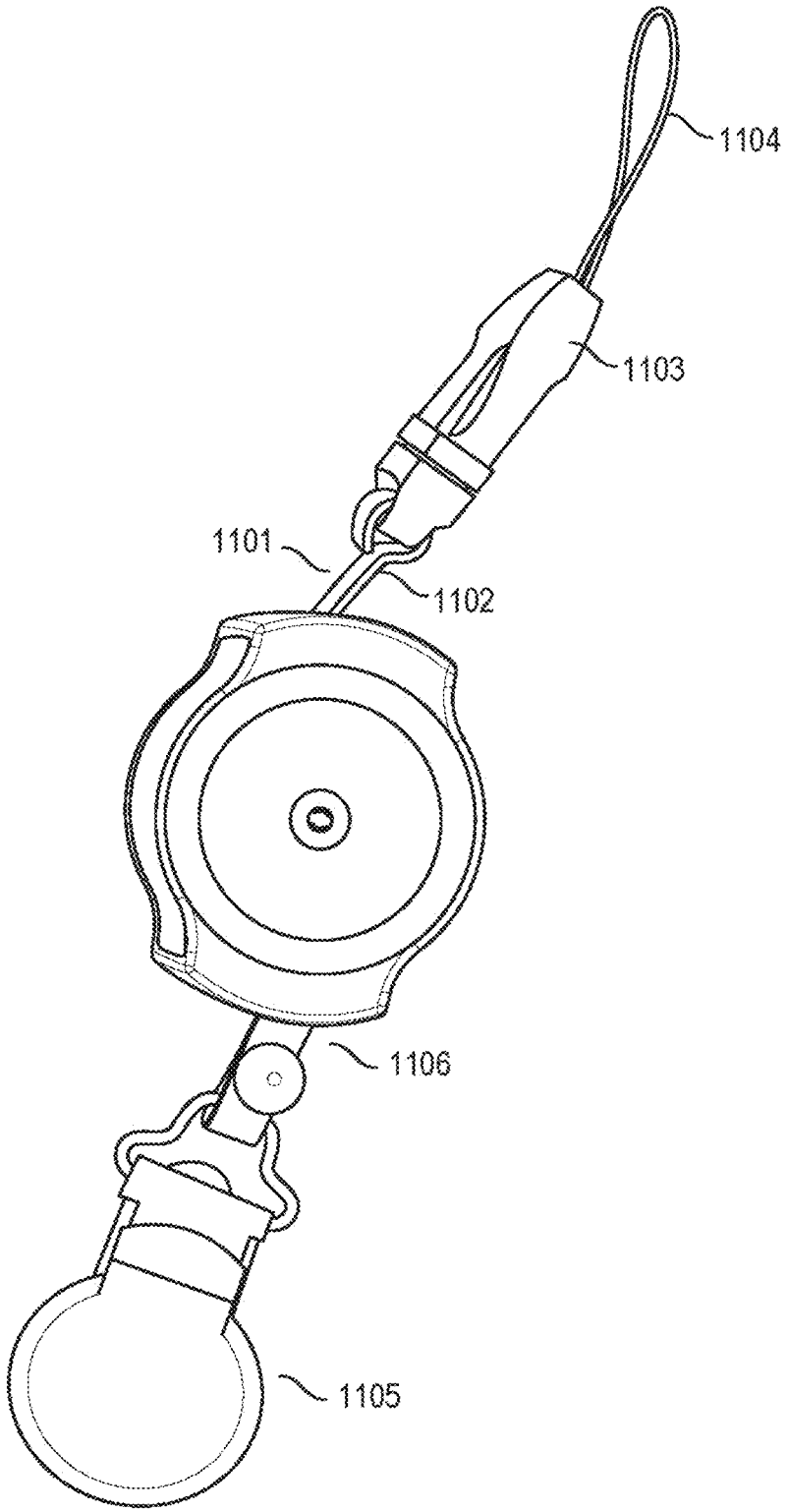
FIG. 11 illustrates the top view of a retractable pacifier device.

FIG. 11 illustrates a perspective view of an alternate embodiment of the pacifier retention device of FIG. 8. In this embodiment, the distal end 1101 terminates in a hook 1102 that is secured to a quick-release mechanism 1103. The loop 1104 to be attached to a pacifier is secured within the quick-release mechanism 1103. The proximal end 1106 terminates in a circular clip 1105 to maximally engage clothing fabric.

Figure 12:
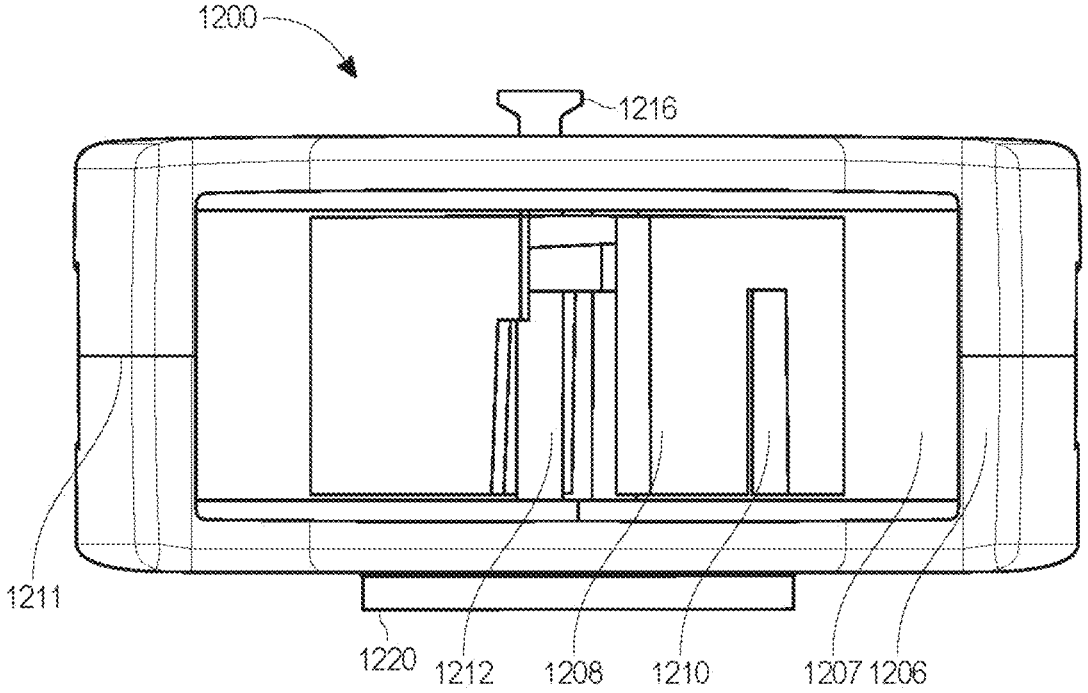
FIG. 12 illustrates the rear view of the housing retention device incorporating a securing nut.

FIG. 12 illustrates a side view of an alternate embodiment of a pacifier retention device house 1200. Side walls 1211 and 1206 form an interior portion 1207. The interior portion 1207 of the housing 1200 includes a spool 1208 having two vertical slots 1210, 1212 adjacent to each other of different heights positioned on its outer circumference. A nut 1216 on a first side of the housing 1200 secures onto a threaded member that passes through the shaft and attaches to a brake member 1220 located on a second side of the housing 1200. When tightened, the brake member 1220 presses against the second side of the housing and the nut 1216 presses against the first side of the housing, causing the housing to press against the spool 1208 and frictionally arrest its rotation within the interior portion 1207.

The pacifier retention device as described herein may be used to connect any relatively light articles to a user's clothing such as pacifiers, bottles, toys, and the like. The pacifier retention device can be mounted to the user's clothing in any interested place such as collar, sleeve, or the like. The pacifier retention device may be made from waterproof and resilient materials, including materials which are inherently microbial or capable of being applied with a microbial coating for improved sanitation.

While preferred embodiments of the present invention have been illustrated for the purpose of the present disclosure, changes in the arrangement and construction of parts and the performance of steps can be made by those skilled in the art, such changes being encompassed within the scope and spirit of the present invention as defined by the appended claims.

What is claimed is:

1. A pacifier retention device comprising:

a. A housing having a front face and a back face, the housing further comprising a sidewall interposed between the front face and the back face, the side wall comprising a first opening and a second opening, the front face, back face, and sidewall forming an interior portion;

b. A spool positioned within the interior portion, the spool having at least two slots allowing passage through the spool, a first channel disposed around the circumference of the spool, a second channel disposed around the circumference of the spool in parallel to the first channel, the spool-rotatable about a shaft, the shaft secured between the front face and the back face;

c. A threaded member extending from the shaft through the housing, wherein a nut secures onto the threaded member that upon tightening forces the housing against the spool to frictionally seize it and prevent its rotation;

d. A tether having a proximal end and a distal end, the tether having a middle portion along the length of the tether, the middle portion being located substantially within the center of the spool, the proximal end extending through a first slot, the distal end extending through a second slot, the proximal end further extending through the first opening, the distal end further extending through the second opening;

e. A spiral spring fixed within the housing, wherein the tether can be moved under tension between a first position, wherein the proximal end is wound around the spool and within the first channel and the distal end is wound around the spool within the second channel, and a second position wherein the entire length of the proximal end extends from the first slot out of the first channel and out through the first opening and the entire length of the distal end extends from the second slot out of the second channel and out through the second opening, and wherein the spiral spring is configured to be housed within the spool, affixed between an inner surface of the spool and the shaft, to provide angular tension on the spool.

2. The pacifier retention device of claim 1, wherein the proximal end comprises a clip for fastening onto clothing.

3. The pacifier retention device of claim 1, wherein the distal end comprises a loop.

4. The pacifier retention device of claim 3, wherein the loop is secured to a pacifier.

5. The pacifier retention device of claim 1, wherein the distal end comprises a holding means to secure the pacifier device.

6. The pacifier retention device of claim 1, wherein the tension force of the spiral spring may be adjusted.

7. The pacifier retention device of claim 1, wherein the spool is automatically retracted from the first position to the second position upon release of tension on the tether.

8. The pacifier retention device of claim 1, wherein the distal end comprises a removable clip, wherein a loop extends from the removable clip, wherein the loop is secured to a pacifier.

* * * * *